US011122839B2

(12) United States Patent
Godenzi

(10) Patent No.: US 11,122,839 B2
(45) Date of Patent: Sep. 21, 2021

(54) SPORT UNDERGARMENT

(71) Applicant: LA BALZA S.r.l., Castel Goffredo (IT)

(72) Inventor: Elena Godenzi, Castel Goffredo (IT)

(73) Assignee: LA BALZA S.R.L., Castel Goffredo (IT)

( * ) Notice: Subject to any disclaimer, the term of this patent is extended or adjusted under 35 U.S.C. 154(b) by 101 days.

(21) Appl. No.: 16/553,197

(22) Filed: Aug. 28, 2019

(65) Prior Publication Data

US 2020/0077717 A1 Mar. 12, 2020

(30) Foreign Application Priority Data

Sep. 6, 2018 (IT) ..... 102018000008390

(51) Int. Cl.
*A41B 9/00* (2006.01)

(52) U.S. Cl.
CPC ..... *A41B 9/001* (2013.01); *A41B 2400/80* (2013.01); *A41D 2600/10* (2013.01)

(58) Field of Classification Search
CPC ..... A41B 9/00; A41B 24/008; A41D 2600/10
USPC ..... 2/400
See application file for complete search history.

(56) References Cited

U.S. PATENT DOCUMENTS 2,468,346 A * 4/1949 Rayden ..... A41C 1/003 450/105
2,476,585 A * 7/1949 Cohen ..... A41C 1/02 450/105
3,823,721 A * 7/1974 Herbener ..... A41B 9/08 450/100
4,446,575 A * 5/1984 Davis ..... A41D 13/1254 2/400
5,207,663 A * 5/1993 McQueen ..... A61F 5/4401 2/400
2008/0034461 A1 2/2008 Gidish
2008/0295227 A1* 12/2008 Welsch ..... D06M 15/643 2/401
2016/0361190 A1* 12/2016 Caden ..... A61F 5/028
2018/0177245 A1* 6/2018 Glaude ..... A41C 1/08
2018/0289077 A1* 10/2018 Glaude ..... A41C 1/08
2019/0320726 A1* 10/2019 Profeta ..... A41B 9/04
2020/0128619 A1* 4/2020 Damnjanovic ..... H04W 88/04

FOREIGN PATENT DOCUMENTS

EP 2189072 B1 5/2010
WO 2005063061 A1 7/2005

* cited by examiner

*Primary Examiner* — Gloria M Hale
(74) *Attorney, Agent, or Firm* — Volpe Koenig

(57) ABSTRACT

A sport undergarment for running or similar sports includes a main opening having a strap to be worn on the hips of a user and a main portion connected to said strap and provided with two side openings, each for the insertion of a respective leg and provided with a respective side edge to be fitted at the level of the groin and/or thigh of the user when the undergarment is worn, is described. The main portion of the undergarment is configured so that at least one intermediate back portion thereof can be inserted into the intergluteal groove between the buttocks of the user and has at least first anti-slip means for restraining the at least one intermediate back portion in-between the buttocks of the user.

11 Claims, 6 Drawing Sheets

SPORT UNDERGARMENT

FIELD OF THE INVENTION

The present invention concerns the field of sport undergarments and especially concerns an undergarment, especially for running or similar sports. The term running is to be understood as the practice of on-foot activities in general, running, jogging or walking.

BACKGROUND

Irritations can form at the level of the joining of the thighs, groin and/or buttocks when doing sports activities particularly prolonged over time, such as running, walking, cycling or the like, due to the rubbing of body parts with each other, caused by the movement of the legs of the user and sweat. In fact, running can cause skin inflammations and excoriations which appear as a result of the continuous friction between two points of the skin; such effect is worsened if skin is particularly damp due to sweat and also in the presence of hairs, especially if in the regrowth step after unwanted hair removal. The athletes who travel very long distances, who undergo intense training and all of those fighting against overweight are most affected by this type of irritation.

Usually, it is not possible to continue to train once the irritation has appeared since the following workout would create new friction on irritated skin. This can be particularly problematic, especially in the case of athletes who practice said sports at competitive level and who thus need to train frequently.

To date, attempts are being made to prevent the onset of skin irritations due to rubbing by using protective creams or balms to be applied before training on the critical points, such as to form a sort of protective film that protects the skin.

However, the use of the aforesaid creams does not always offer the desired result, especially in the case of sports activities prolonged over time. Thus, irritations to be cured with anti-inflammatory and soothing creams can form, which disadvantageously imply the need to suspend sports activities until the irritation itself has disappeared.

There are undergarments for these activities, such as briefs, boxers and the like, but these are only characterized by being made of a breathable fabric, by being devoid of side seams and by having a supporting function. In any case, they do not have any characteristic able to prevent inflammations from rubbing at the level of the buttocks and/or groin.

The document WO 2005/063061 A1 refers to a string for a textile garment which must be worn by an individual, comprising at least one string strip or section, wherein the at least one string strip or section is branched out from a V-shaped piece having outwardly curved branches.

The European patent application EP 2 189072 A1 concerns a garment comprising a strap portion, a front portion and two belt-like parts, wherein the front portion extends from the strap portion and tapers at an apex and a connecting portion connects the apex to a joining region from which the two belt portions extend until the strap portion.

However, such garments are not very comfortable for doing sports activities and do not in any way prevent irritations due to the rubbing of the buttocks or thighs described above.

SUMMARY

An object of the present invention is to provide an undergarment to be worn at the level of the pelvis of a user during sports activities such as running, walking, jogging and the like, which solves the drawbacks of the known art.

A further object of the present invention is to provide an undergarment that is comfortable, breathable and simple and economic to make.

These and other objects are achieved by an undergarment for running according to claim 1.

In particular, the undergarment is appropriate for being worn at the level of the pelvis of a user and comprises a main opening provided with a strap to be worn on the thighs/waist, a main portion having two side openings, each for the insertion of a leg of the user. Advantageously, the undergarment has a back portion sized so that at least one intermediate part thereof can be inserted into the intergluteal groove, between the buttocks of the user, and has at least first anti-slip means, at said intermediate part, for restraining it in-between the buttocks of the user despite the relative movements of the buttocks due to the sports activity.

In a preferred solution, at least at the intermediate part of the main portion to be inserted between the gluteal muscles, the main portion has a central opening having respective inner edges with which the first anti-slip means are combined. Such opening allows to better position the garment and to maintain the part of the main portion associated with a buttock separated with respect to that associated with the other, thus better ensuring the correct positioning, despite the opposite movements to which the buttocks are subjected while running.

Still more preferably, the central opening subdivides the main portion in two strips joined with the strap and at least partially separated from one another. This way, the strip associated with one leg is almost completely independent of the one associated with the other, thus even better ensuring the correct positioning of the garment throughout the sports activity.

Advantageously, the garment is made of a breathable synthetic fabric to prevent accumulations of sweat, and can have a gusset made of cotton or an antibacterial and/or hypoallergenic material at least in proximity of the portion to be worn at the pubis of the user. The presence of such gusset is particularly advantageous when the garment is intended for female users. Moreover, the garment can be made of an elastic material to better adapt itself to the body.

Preferably, the undergarment further comprises second anti-slip means combined with the openings for the insertion of the legs and possibly third anti-slip means to secure the garment to the waist of the user.

Advantageously, the anti-slip means have a strip-like shape of an anti-slip material, and specifically of a silicone rubber, preferably of the hypoallergenic type.

Advantageously, each strip narrows starting from the strap towards the pubic region.

In a particularly preferred configuration, each strip can have the same width throughout its entire extension. In this case, a part of each strip is intended to overlap the other in the pubic region when worn.

This configuration is particularly advantageous, especially from a productive point of view since it allows to obtain the whole garment starting from three bands of linear elastic fabric with continuously silicone coating: once sewn, if necessary, the first band, at its short sides, constitutes the strap and the other two bands, identical and each having an oblique side, define the strips of the garment once they have been sewn to the strap at their short sides.

In specific, the two oblique sides are provided to confer a curvature to the back part of the garment to be worn on the buttocks.

BRIEF DESCRIPTION OF THE DRAWINGS

Further characteristics and advantages of the invention will be better highlighted by the review of the following detailed description of a preferred, but not exclusive, embodiment illustrated by way of example and without limitations, with the aid of the accompanying drawings, in which.

DETAILED DESCRIPTION OF THE PREFERRED EMBODIMENTS

Figure 1:
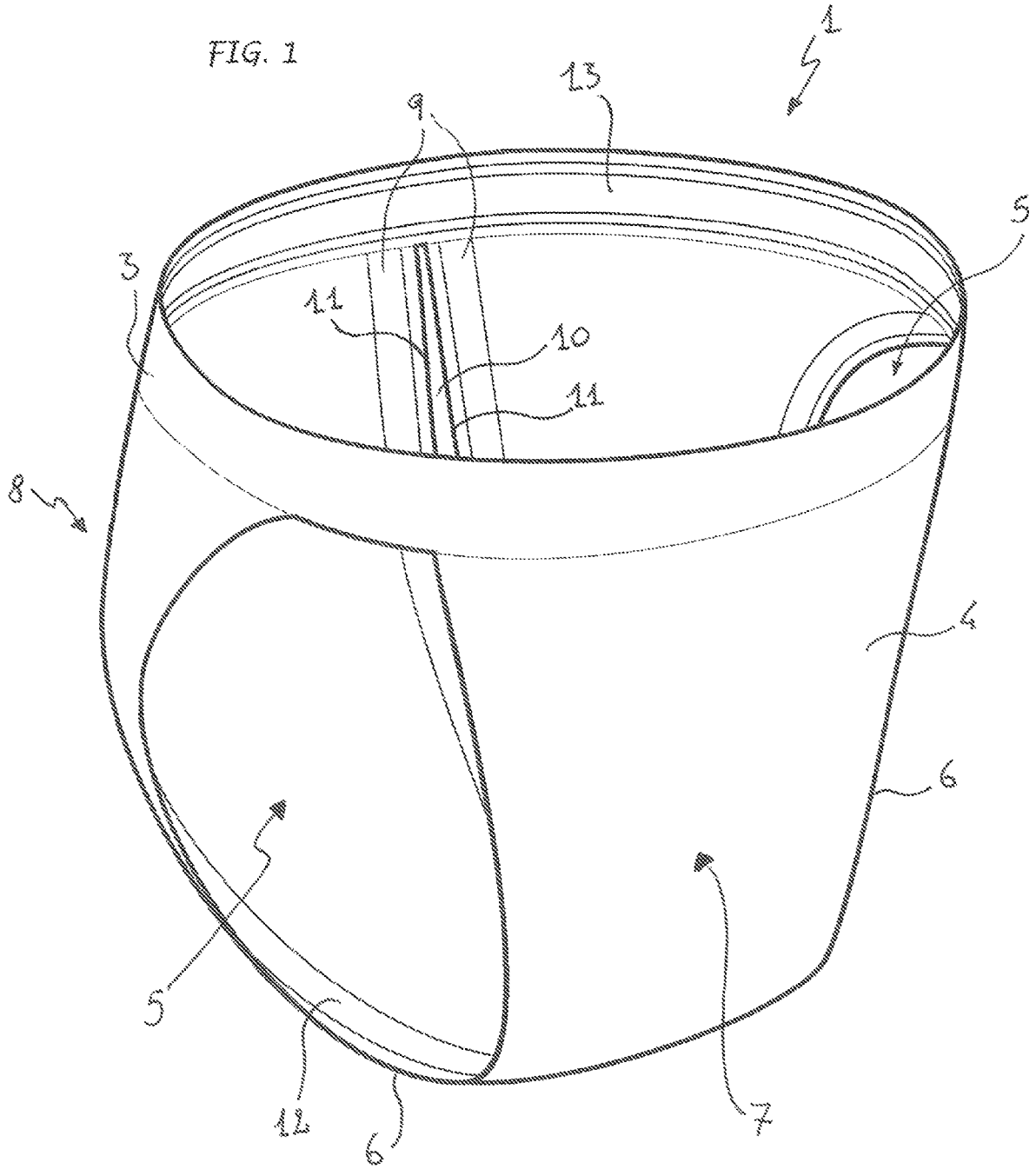
FIG. 1 shows a perspective front view of an embodiment of a sport undergarment, especially for running, according to the present invention.

With reference to the figures, an undergarment 1 for sports activities, and especially running, according to the present invention is shown. In particular, the undergarment 1 is similar to underwear, briefs, boxers, etc. and is adapted to cover the part of the body of a user which goes from the waist to the groin and possibly at least part of the thigh. The garment can be worn by both male and female users.

The undergarment 1 comprises a main opening 2 to allow to wear the garment itself and provided with a strap 3 to be fitted around the waist of the user when the garment is worn and a main portion 4 connected to the strap and having two side openings 5, each for the insertion of a respective leg and each provided with a respective side edge 6 to be fitted at the level of the groin and/or thigh of the user when the undergarment is worn.

The garment comprises a front part 7 and a back part 8 to be worn at the level of the buttocks of the user.

According to the invention, the main portion 4 is configured so that to be inserted at least partially into the intergluteal groove between the buttocks of the user and has first anti-slip means 9 for restraining the part of the main portion properly positioned in-between the buttocks.

Figure 2:
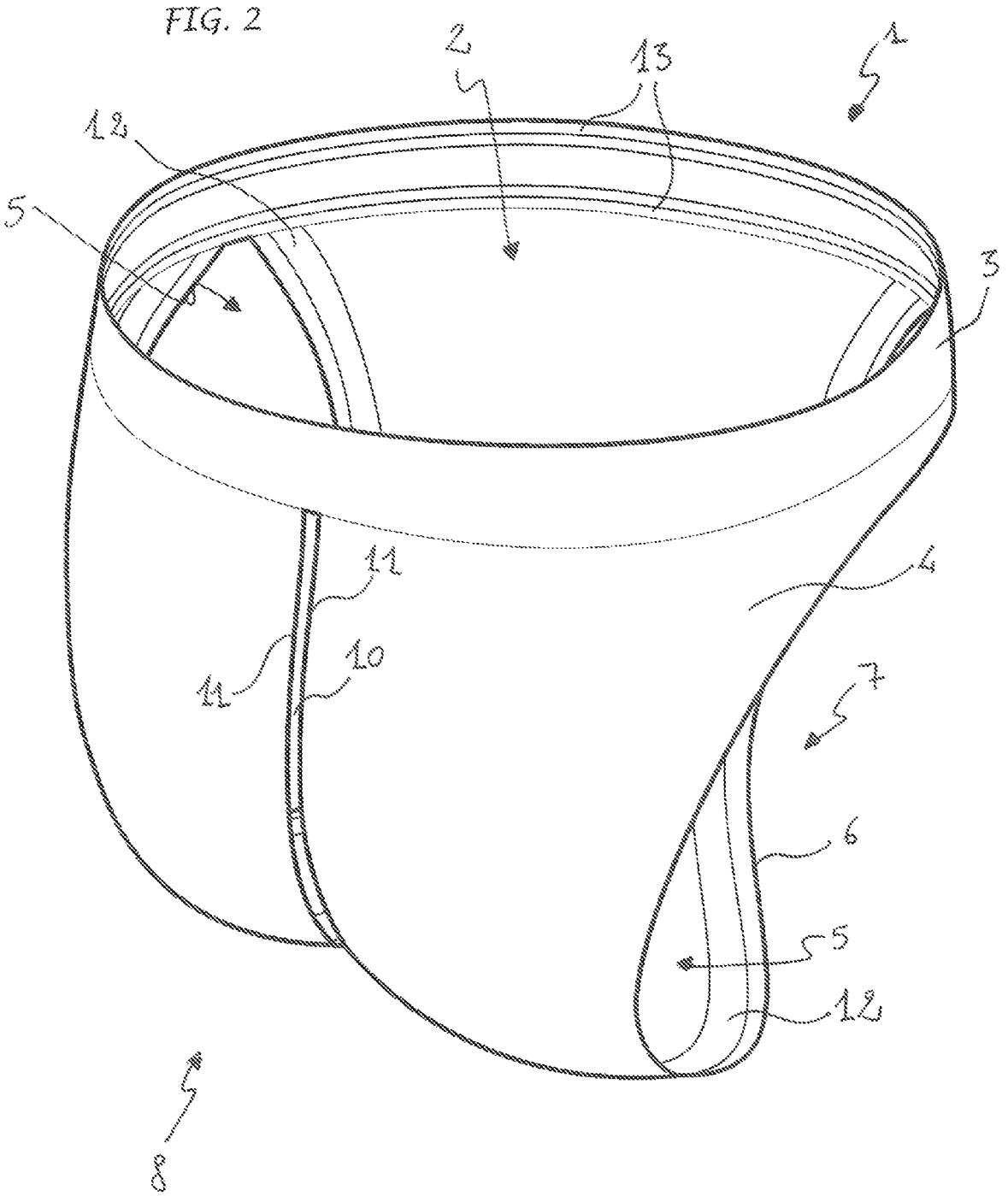
FIG. 2 shows a perspective rear view of the garment of FIG. 1.

In an embodiment shown in FIGS. 1 and 2, the main portion has a central opening 10 extending at least at an intermediate portion of the back part 8 to be worn at the intergluteal groove of the user; such central opening has an inner edge 11 on each side.

Preferably, such central opening also extends at the level of at least one portion of the front part of the main portion 4.

Figure 3:
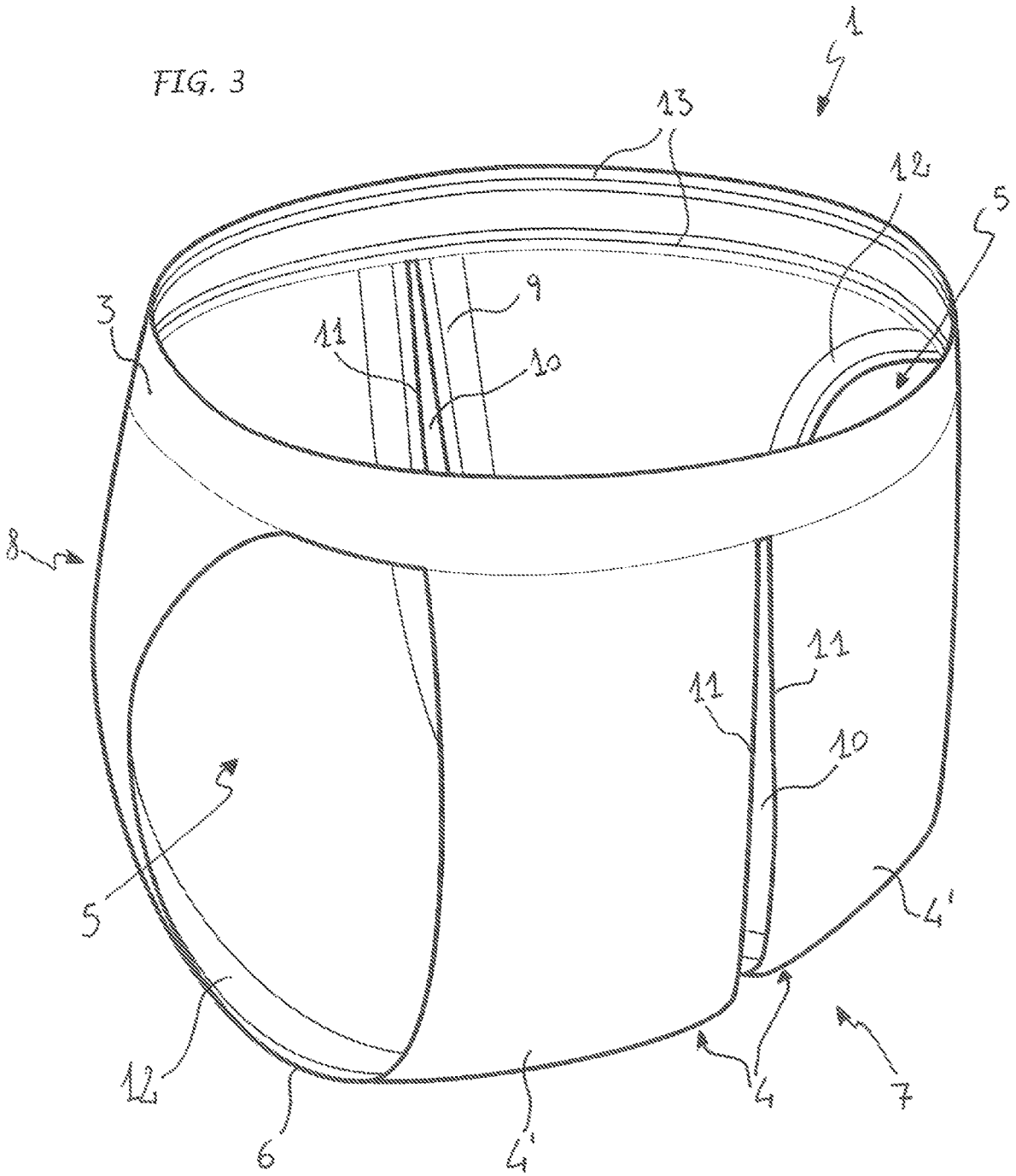
FIG. 3 shows a perspective front view of a further embodiment of a sport undergarment according to the present invention.
Figure 4:
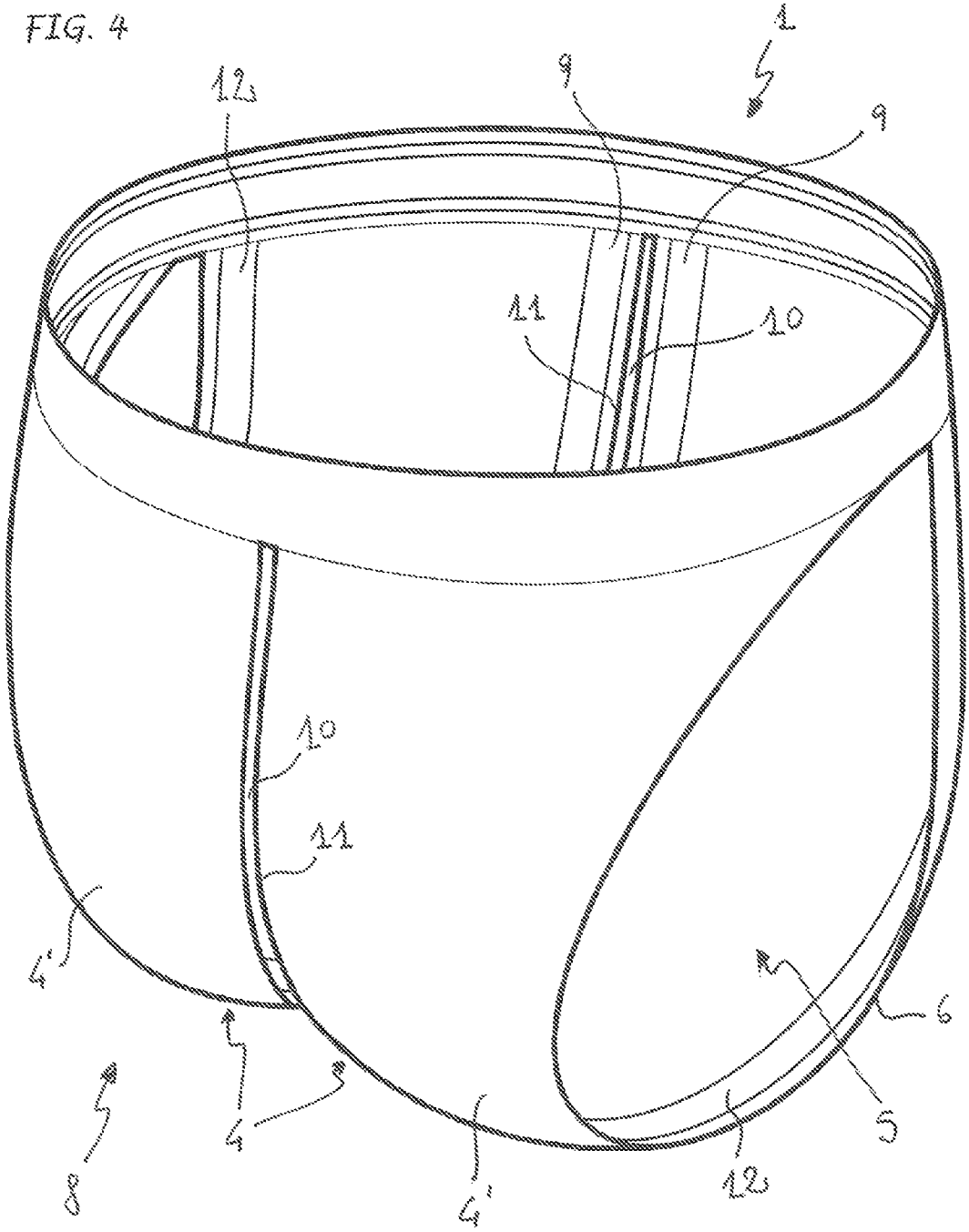
FIG. 4 shows a perspective rear view of the garment of FIG. 3.
Figure 5:
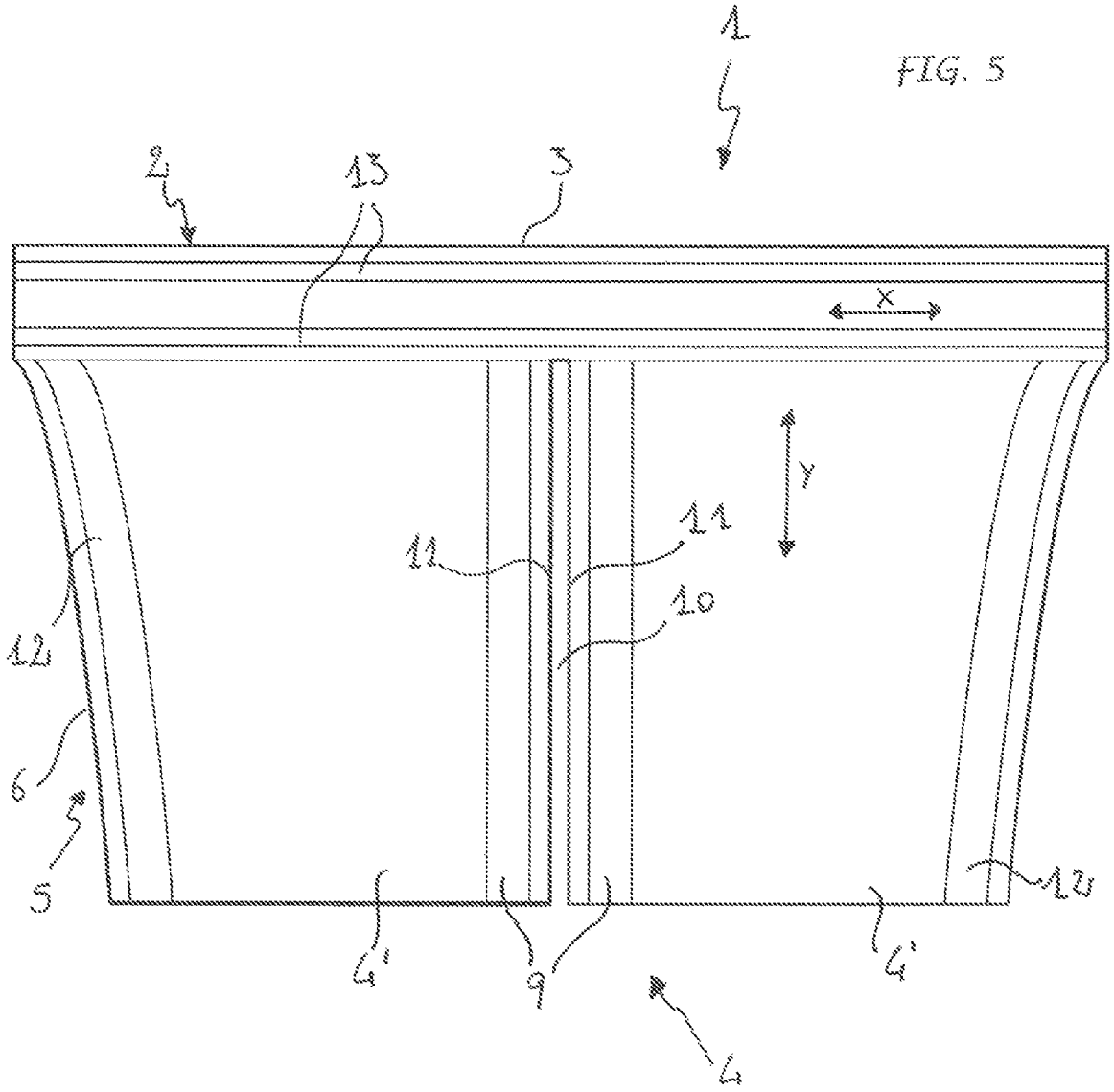
FIG. 5 shows a rear view of the inner part of the undergarment of FIG. 3.

In a particularly preferred solution shown in FIGS. 3-5, the main portion 4 comprises two strips 4' substantially separated from one another, each connected to the strap 3 and each provided with a respective side edge 6 and with an inner edge 11; in such embodiment, the central opening thus practically extends along the whole back part and front part of the main portion 4.

The first anti-slip means 9 are provided inside the garment, at least at the level of the back part 8 of the garment itself, at or in proximity of each inner edge 11 so that to be in contact with the body of the user to maintain at least said back part of the respective inner edge 11 tight and firm on the skin of the user.

Figure 6:
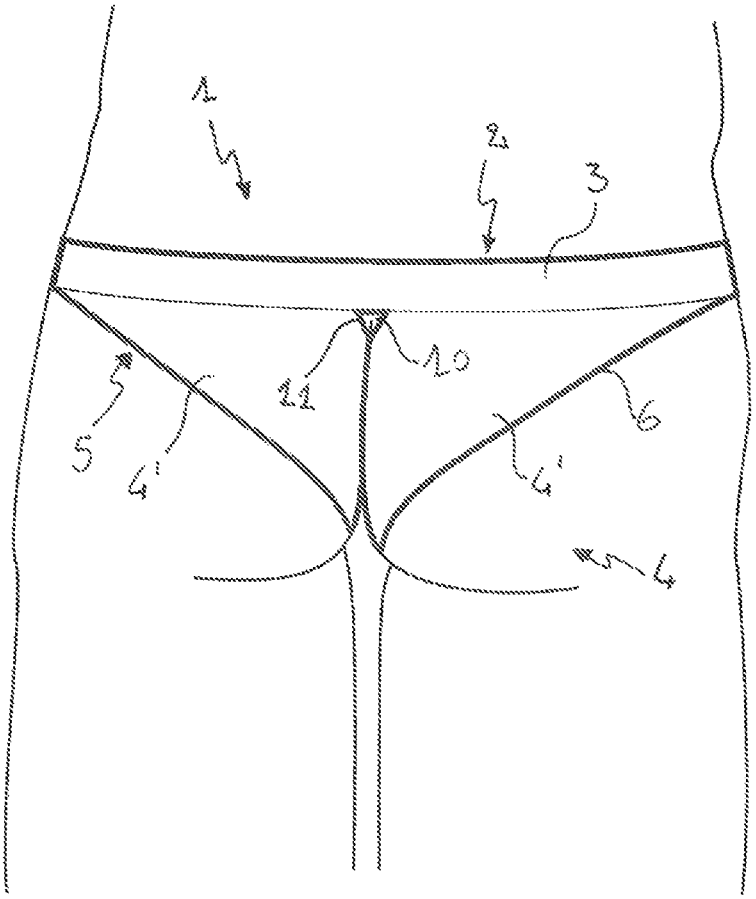
FIG. 6 shows a perspective rear view of the undergarment according to the present invention, when worn by a user.

The main portion 4, both whether made in one piece or whether or not provided with the central opening 10, which is in the form of strips 4' separated from one another, is sized and configured so that one intermediate portion thereof and, together with it, the first anti-slip means 9 can be inserted in-between the buttocks of the user, as shown in FIG. 6. This prevents the buttocks from rubbing against one another during the sports activity and especially when running, walking and the like. In fact, thanks to such configuration, there is no more rubbing between the skin of the buttocks, but between two parts of the garment, which are properly held in the intergluteal groove, and thus in-between the buttocks, by the first anti-slip means.

Advantageously, the garment is made of a synthetic and breathable fabric so that to facilitate the sliding of the parts of the garment one against the other and to prevent sweat from forming and accumulating, which could make the garment less effective if it impregnates the latter.

Preferably, the first anti-slip means 9 practically extend along the whole extension of the inner edges 11, to maintain them completely against the user's body and to ensure the proper positioning and seal of the inner edge, despite the prolonged and rapid movement of the legs.

In a particularly preferred way, second anti-slip means 12 are also provided at each of the side edges of the garment. This configuration allows to maintain the garment against the groin and/or thigh and buttocks of the user, in order to maintain the garment in the proper position and to avoid any rubbing between the garment itself and the groin, thus preventing possible irritations. Advantageously, the main portion can have, at the level of an intermediate portion thereof to be worn on the pubic region of the user, a gusset made of cotton or antibacterial material.

Still more preferably, the garment also has at least third anti-slip means 13 next to at least one, but preferably both of the inner edges of the strap 3, so that to maintain the garment perfectly against the body, when worn.

Both the strap 3 and the main portion 4 are made of a fabric elastic especially in a transverse direction thereof, respectively denoted by the arrows X and Y in FIG. 5. In fact, such elasticity allows the garment to be worn and to remain tight to the waist and gluteal muscles of the user. The garment can be made in different sizes depending on the size and gender of the user in order to be used by athletes of different ages and different physical structures.

Advantageously, the first, second and third anti-slip means 9, 12 and 13 are made by strips of an anti-slip material, for example silicone rubber, preferably of hypoallergenic type.

Advantageously, each strip 4' can have the same width throughout its extension; as an alternative, each strip can narrow starting from the portions connected to the strap, towards the pubic region, to provide a garment having a greater leg-opening when worn.

For a proper and effective use of the undergarment, it is necessary to slip each leg in the main opening of the garment and in a respective side opening; to slide the garment along the legs until the strap reaches the thighs/waist of the user and the side edges are arranged on the groin and gluteal muscles of the user; to insert at least an intermediate back part in-between the buttocks of the user and to make the first anti-slip means adhere to the inner part of the buttocks of the user himself, so that the garment stays properly fitted.

In the event of a garment having the intermediate portion consisting of two strips, it can also be necessary to overlap the front part of the strips, in addition to inserting the inner edges with the relative first anti-slip means in-between the buttocks, in order to cover the pubic region.

The invention claimed is:

1. An undergarment (1) comprising a main opening (2) having a strap (3) to be worn on hips of a user, and a main portion (4) connected to said strap and provided with two side openings (5), each configured to be fitted at a level of a respective user's leg, and provided with a respective side edge (6) configured to be fitted at the level of the user's groin and/or thigh of the user when the undergarment is worn, said main portion comprises a back part (8), having an intermediate back part that is configured to be inserted into an intergluteal groove between the user's buttocks and has at least first anti-slip means (9) for restraining said intermediate back part in-between the user's buttocks, wherein the main portion (4) comprises at least one central opening (10), extending at least in correspondence to the entire intermediate back part of the back part (8) to be worn at the user's entire intergluteal groove, said central opening is provided with inner edges (11) configured to be inserted in-between the user's buttocks, and said first anti-slip means (9) are provided inside the undergarment, at or near the inner edges (11), at least at the level of the back part (8) of the undergarment.

2. The undergarment (1) according to claim 1, wherein the main portion (4) comprises two strips (4') joined with the strap and separated from one another by said central opening at least in correspondence to the intermediate back part, each strip being provided with a respective side edge (6) and a respective inner edge (11), and wherein said inner edges are configured to be inserted in-between the buttocks of the user.

3. The undergarment (1) according to claim 1, wherein at least the main portion is made of a breathable synthetic fabric.

4. The undergarment (1) according to claim 2, wherein the strips are substantially completely separated from one another and the first anti-slip means (9) extend along all of the inner edges (11).

5. The undergarment (1) according to claim 2, wherein second anti-slip means (12) are provided inside the garment, at or near each of the side edges (6) of the garment, and with third anti-slip means (13) at or near one or both of the inner edges of the strap (3), in order to maintain the undergarment in place when worn.

6. The undergarment (1) according to claim 1, further comprising a gusset made of cotton or of an antibacterial material, which is arranged at a part of the main portion to be worn in contact with the user's pubic region.

7. The undergarment (1) according to claim 1, wherein the strap (3) and/or the main portion (4) are made of an elastic fabric.

8. The undergarment (1) according to claim 5, wherein the first anti-slip means (9) and the second and third anti-slip means (12, 13) comprise strips made of an anti-slip material.

9. The undergarment (1) according to claim 2, wherein each strip (4') is equal in width along an entire length thereof and wherein each strip is configured to overlap the other in the user's pubic region, when worn, or wherein each strip narrows starting from the strap towards the user's pubic region.

10. The undergarment (1) according to claim 4, wherein each strip (4') is equal in width along its entire extent and wherein each strip is configured to overlap the other in the user's pubic region, when worn, or wherein each strip narrows starting from the strap towards the user's pubic region.

11. The undergarment (1) according to claim 8, wherein the anti-slip material is silicone rubber or hypoallergenic silicone rubber.

* * * * *